US005181644A

United States Patent [19]

Ferrell

[11] Patent Number: 5,181,644

[45] Date of Patent: Jan. 26, 1993

[54] NAIL DRIVER

[76] Inventor: Landon W. Ferrell, 1921 Pleasant View La., Knoxville, Tenn. 37914

[21] Appl. No.: 819,804

[22] Filed: Jan. 13, 1992

[51] Int. Cl.[5] ..... B25C 1/02

[52] U.S. Cl. ..... 227/147

[58] Field of Search ..... 227/147, 113, 156

[56] References Cited

U.S. PATENT DOCUMENTS

| | | | |
|---|---|---|---|
| 1,106,241 | 8/1914 | Richardson | 227/147 |
| 3,147,484 | 9/1964 | Nelson | 227/147 X |
| 3,324,542 | 6/1967 | Hilti . | |
| 3,979,040 | 9/1976 | Denin . | |
| 4,299,021 | 11/1981 | Williams . | |
| 4,461,418 | 7/1984 | Schaefer | 227/147 |
| 4,562,948 | 1/1986 | Floyd . | |
| 4,676,424 | 6/1987 | Meador et al. | 227/147 |
| 4,901,712 | 2/1990 | Voegell . | |

*Primary Examiner*—Frank T. Yost
*Assistant Examiner*—Rinaldi Rade
*Attorney, Agent, or Firm*—Richard C. Litman

[57] ABSTRACT

A nail driver comprises a driving rod sliding within a barrel. The rod passes hammer blow forces to the head of a nail as fully contained within the barrel, while the barrel aligns the rod and the nail, even in the case of bent nails. If the nail bends or was bent when the tool is applied, the barrel bore limits the bending so that the nail may still be driven in. A strike head on the outer end of the rod may be either adjusted or replaced with alternately sized heads whereby variations in the effective displacement of the rod is achieved. In this manner, hammer blows upon the strike head will produce a known displacement of the rod and thus a fixed amount of driving to nails as inserted into the barrel.

6 Claims, 1 Drawing Sheet

NAIL DRIVER

FIELD OF THE INVENTION

The present invention relates generally, to nail driving devices, and more particularly to an improved tool allowing for the driving and/or setting, of nails or the like, especially when in the bent condition.

BACKGROUND OF THE INVENTION

It is a common problem for a nail to bend when being driven into hard material, such as very hard wood, a knot in a board, or brittle materials like plaster. Due to cost, and the hazards of fracture with stronger but more brittle material, nails are made of mild steel. They are suited only for moderately resistive materials, and often will buckle and bend under a hammer blow when the impact is not truly axially absorbed by the driving of the nail into the surface or, variations in the material density is encountered by the nail point.

Once a nail bends, it is generally deemed useless and discarded. Often, attempts are made to salvage a nail that has become bent prior to being fully driven, by striking its shank from the side or even by removing it with the hammer's claw and striking upon a firm surface to restraighten the nail shank. In the latter instance, the nail is thereafter reinserted into the workpiece and driven in by the hammer. In any case, these prior efforts are time consuming and thus wasteful of both hammering time and material. Thus, a device is needed which will allow a bent nail to be driven the remainder of the distance into a wooden or other composition of material.

DESCRIPTION OF THE PRIOR ART

The prior art teaches many devices for driving nails. Douglas Voegell and Robert Assell, in U.S. Pat. No. 4,901,712 issued Feb. 20, 1990, describe a surgical bone nailer for driving nails or screws into bone by the application of compressed air upon a piston. The nail is held in a housing having a cylindrical bore with the head resting against the end of a driver. It is this driver which is urged by an air piston to push the nail out through the bore of the housing and into the bone.

The bore of the housing has along most of its length an internal diameter which is adapted to closely hold the cylindrical head of the special surgical nail to keep it straight. At a distance inside the bore which is about equal to the length of the nail, the internal diameter is narrowed enough to slightly interfere with the nail head. The nail head is forced into this constricted region to be held there prior to driving.

U.S. Pat. No. 3,324,542, issued to M. Hilti on Jun. 13, 1967, shows a nailing system adapted for use in concrete and cement and employs a heavy tubular guide having a cylindrical bore perpendicular to a planar end face. The end face rests on a concrete surface in use while a piston slides freely within the bore of the guide. The piston is connected to a driving member in a second, slightly larger bore disposed above the first bore but axially aligned with it. When the driving member is hit by a hammer, it strikes the piston, which in turn drives a special nail-like fastener which has been placed within the first bore between the piston and the concrete.

The Hilti fastening device, comprising the guide, bores, and piston and driving member, could be used to drive nails. However, it is much larger, bulkier and heavier than is needed for such a use, as it needs to withstand the very heavy blows needed for concrete. Also, it has a wide base, which prevents it from being tilted to drive a nail at an angle. Other drawbacks are that two bores and two drivers are employed, which adds cost and complexity and reduces the hammer impact to the nail.

Luther Williams, in U.S. Pat. No. 4,299,021 issued on Nov. 10, 1981, discloses an axial impact tool for nailing in hard-to-reach places. The tool consists of a guide tube in which an impact rod freely slides, with this rod having a heavy mass fixed at one end and protruding from the guide tube. The other end of the rod, which remains inside, has a permanent magnet tip attached for holding a nail head in place against the end of the rod. With the head held flat against the rod end by magnetism, the shank of the nail extends straight down the bore of the guide tube. No hammer is used and the mass at the end of the rod is used to supply the impact momentum for driving the nails.

U.S. Pat. No. 3,979,040, issued to Adam Denin on Sep. 7, 1976, shows a nail driver having all the parts of Williams' tool except the magnetic tip on the rod. Instead, Denin uses a collar surrounding the outside of the tube at the bottom, or drive end. The collar contains small cylindrical magnets arrayed around the outside of the tube with the magnetic field from these magnets penetrating the tube and holding the nail inside the end of the tube.

Robert Floyd, in U.S. Pat. No. 4,562,948 issued on Jan. 7, 1986, shows a nail driving tool similar to that of Williams. The Floyd tool includes a tubular body with a hand grip, a driving rod, and a magnet at the end of the rod but does not use a mass, though. Instead a hammer is used to hit the end of the rod distal the nail.

All of these inventions suffer from the drawback that the depth to which the nail is driven is not adjustable. Voegell et al. show means to stop the insertion of the nail (see FIG. 3; part 38 will stop against part 40), but this means is not adjustable. Williams discloses the use of various lengths of driving rods to allow the fasteners to be driven to different depths. This technique requires many different rods and laborious disassembly and reassembly for changing the depth. It is not continuously adjustable, but can only drive nail heads to the discrete depths corresponding to the various rods.

None of the above inventions and patents solves the problem of making a nail driving tool which is compact, can be easily disassembled, which will not fall apart into pieces, and which allows for adjustment of the nail head insertion depth.

SUMMARY OF THE INVENTION

The present invention is a nail driver which is adapted to drive nails even if they bend during driving, and which is also useful for driving nails in recesses. It can be adjusted to drive nails to various depths. The driver is used with an ordinary hammer and readily accommodates nails up to 10-penny common size, or even larger. There are three basic parts to the driver: a barrel, a rod, and a collar.

The barrel comprises a section of heavy-walled tubing about 3 inches long and with an internal diameter typically slightly less than 5/16 inches. A ten-penny nail will just fit within a bore of this size. At one end, designated the rear or hammer end, a collar provides a slight constriction, with a diameter of just over ¼ inch. This constriction is short, perhaps ⅜ inch long.

The rod is preferably cylindrical and is about ⅜ inch longer than the barrel and ¼ inch in diameter. The rod slides freely within the collar of the barrel. The nail-contacting end of the rod, designated the inner, forward end because it is inside the barrel, includes an enlarged ring flange encircling the shaft of the rod, having a diameter that forms a close sliding fit within the main barrel bore diameter of about 5/16 inch.

The rod is inserted into the barrel with its rear end opposite the hammer end of the barrel. The barrel and the rod are slidably, and coaxially, aligned with the flange sliding within the bore while the rod slides in the collar constriction. The outer, rear end of the rod, opposite the inner end, is so called because it protrudes from the hammer end of the barrel. Hammer blows are directed at the outer end during use of the device.

A strike head is applied upon the outer end after the rod is inserted into the barrel and through the collar constriction and extends from the hammer end of the barrel.

With the head in place, the rod will not fall out of the barrel. If the rod needs to be removed for any reason, though, the head can be removed. The head's position near the outer end can also be adjusted with a press, or other means. The collar may also be threaded on, or otherwise attached. Whatever method is used, the axial position of the head should be adjustable. This allows the depth to which the nail head is driven to be regulated by the head contacting the barrel. Alternatively, adjustability may be achieved by providing alternate lengths of the rods.

To use the driver, the head of a nail is inserted into the barrel, with the sharp end of the nail spike protruding. If the nail end of the barrel is placed against the surface to be nailed, with a nail inside, the nail will raise the outer end of the rod out of the hammer end of the barrel; the outer end of the rod is hammered to drive the nail.

The nail may be hammered in until the collar abuts against the hammer end of the barrel. The nail may then be directly driven to its proper depth.

Accordingly, one object of the present invention is a nail driver which will not fall apart and be easily lost.

Another object is a nail driver which is compact.

Still another object is a nail driver which can be continuously adjusted to drive nail heads to various depths.

A further object of the present invention is a nail driver which disassembles for maintenance.

An additional object of the present invention is to provide an improved nail driver particularly adapted to accommodate bent nails.

An additional object of the present invention is to provide an improved nail driver including having a barrel adapted to contain a nail and a headed rod in the barrel provided with a strike head having a front face which engages the barrel end to limit the displacement of the nail as the strike head is driven by a hammer.

These and other objects of the present invention will become readily apparent upon further review of the following specification and drawings.

BRIEF DESCRIPTION OF THE DRAWINGS

Similar reference characters designate corresponding elements throughout the several figures of the drawings.

DETAILED DESCRIPTION OF THE PREFERRED EMBODIMENT

Figures 1, 2, 3:
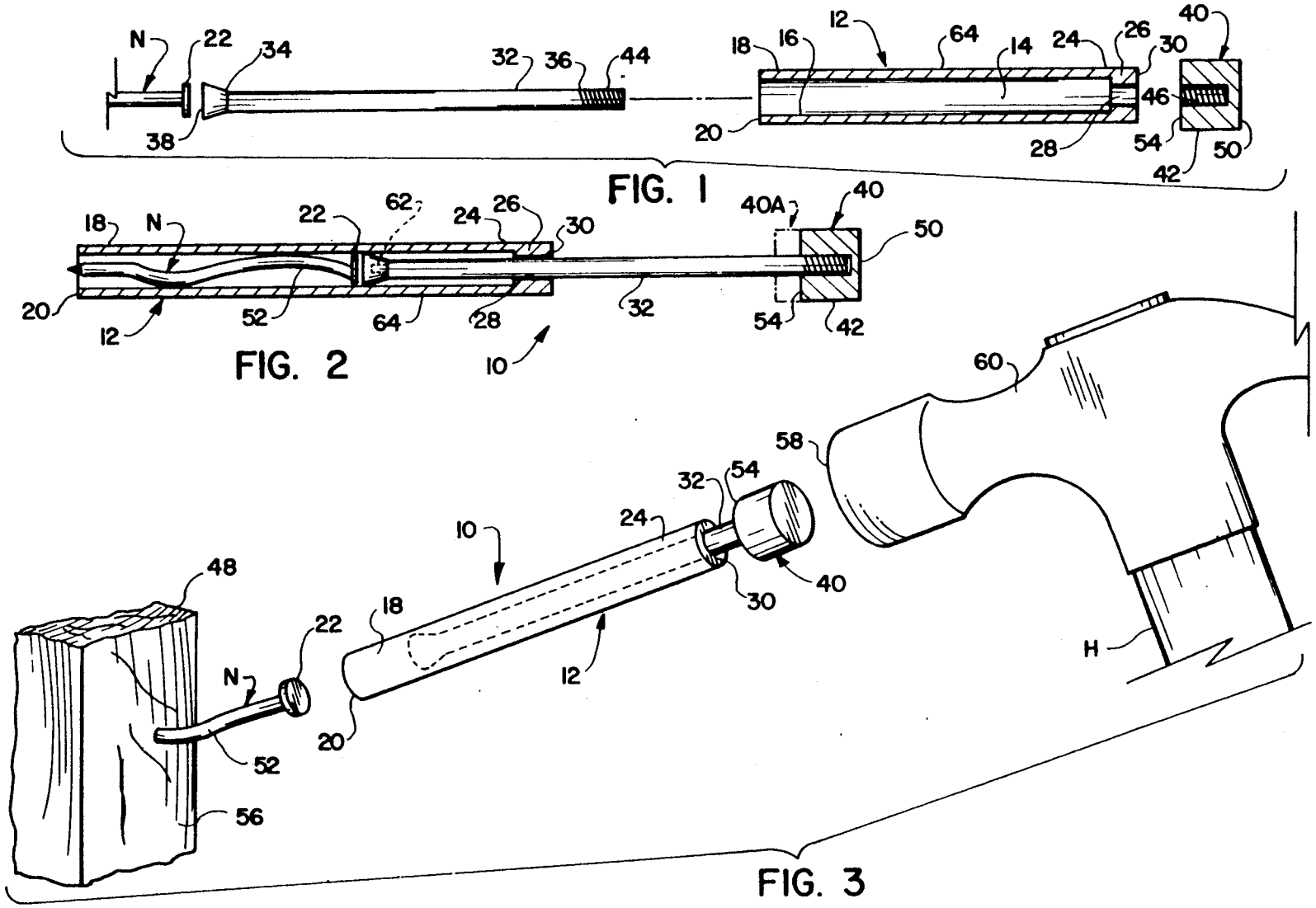
FIG. 1 is an exploded, side elevation, partly in cross-section, of the invention as disassembled and axially aligned with the head portion of a nail.
FIG. 2 is a side elevation of the elements of FIG. 1, appearing as when assembled.
FIG. 3 is a perspective view illustrating the nail driver of the invention in preparation for use with a bent nail.

The present invention comprises a nail driver, generally designated 10 and is shown disassembled in FIG. 1 and as assembled and used, in FIGS. 2 and 3. The tool comprises a barrel 12 having a central passageway 14 as formed by a cylindrical inner wall 16 and will be seen from FIGS. 1 and 2 to include an open forward end 18 terminating in a forward edge 20. The diameter of the bore or passageway 14 will be understood to be just slightly greater than that of the nail head intended to be accommodated. In the case of ten-penny nails, an internal diameter of 5/16 inches will permit a close sliding fit of the nail head 22 within the bore 14.

The rear end 24 of the barrel 12 will be seen to be restricted by a collar 26 or other suitable formation and which includes an axial bore 28 of substantially lesser diameter than that of the bore 14. This collar 26 provides a rear face 30 which is fully opposite to the barrel forward edge 20. The collar bore 28 is adapted to receive, in a closely fitting manner, the cylindrical body of an elongated rod 32, which in turn is formed with a forward end 34 and opposite rearward end 36. This forward end 34 preferably includes a flared or otherwise enlarged drive face 38, the cylindrical periphery of which closely conforms to the barrel inner wall 16, such that when the rod 12 is assembled with the barrel 12, the rod rear end 36 is disposed axially beyond the rear face 30 of the barrel as most clearly shown in FIG. 2 of the drawings. With this arrangement, the rod is precluded from removal from the barrel when displaced rearwardly thereof, since the enlarged flange portion 34 abuts the restriction as presented by the bore through the barrel collar 26. With the foregoing in mind, it will be understood that assembly of the rod component 32 with the barrel component 32 is accomplished by inserting the rod rearward end 36 past the forward edge 20 of the barrel and thence through the collar bore 28 until the rearward end 36 of the rod is well past the barrel rearward face 30, as illustrated in FIG. 2.

The assembly is completed by the attachment of a strike head 40 to the rod rearward end 36. This strike head 40 comprises an enlarged rigid body preferably having a cylindrical periphery 42 and which defines a diameter no less than that of the barrel rear end collar 26. The head 40 is removably secured to the rod end by any suitable means permitting of ready separation and reattachment thereto, such as the illustrated cooperating external threads 44 on the rod end 36 and internally threaded bore 46 in the strike head 40. Any well known alternative means may be employed to allow for the above removable strike head attachment, such as a press-on fit.

In using the tool 10 as shown in FIG. 3, wherein a bent nail N is partially driven into a workpiece 48, the user will apply the tool by slipping the forward barrel end 18 about the nail head 22 and holding its forward edge 20 against the workpiece 48 with one hand. This motion will obviously displace the rod 32 rearwardly, with the various components appearing as in FIG. 2. The bent nail N may be successfully driven the remainder of the way by striking the rear face 50 of the strike head 40, which force is transmitted in an axial manner through the rod 32 and its forward face 38, to the nail head 22 and the shank 52 of the nail. As the serpentine or bent portion of the nail shank 52 is retained in a captive manner within the confines of the relative narrow bore 14 of the barrel 12, it will be appreciated that continued striking of the head 40 will result in further driving of the nail N into the workpiece 48. This action continues until the front face 54 of the head 40 abuts the rear face 30 of the barrel collar 26. It is this abutment that limits the extent of any further driving of the associated nail N. To obtain a precise limitation of the amount of nail shank that will remain from the surface 56 of the workpiece 48, the distance between the enlarged forward end 34 and front face 54 must be predetermined. This may be accomplished in any of different ways, for example, by utilizing strike heads having different axial dimensions so that the front face thereof will be disposed at different points relative the rod rear end 36. FIG. 2 illustrates an alternative strike head 40*a* of greater length and wherein its front face 54*a* will be seen to be disposed further toward the rod forward end 34. By employing such an alternate strike head 40A, obviously any given size of nail N being operated upon will not be driven as deeply into a workpiece. Still another manner of accomplishing such variation is merely to twist the screw threaded head 40 in one direction or the other to vary the distance between its front face 54 and the drive face 38.

Another manner of altering the effective driving length of the tool would be to utilize a different rod having a greater or lesser length. A purpose for limiting the driving distance by whatever means is to preclude the advancement of the rod enlarged drive face 38 to or beyond the barrel forward edge 20 and thereby insure that at least a nominal amount of the nail shank 52 will remain spaced from the workpiece surface 56. In this manner, the user may then strike the nail head 22 directly with the face 58 of the head 60 of the hammer H until the nail N is fully driven into the workpiece. This procedure will often be preferred to using the tool 10 to fully drive the nail since frequently the nail head 22 will be cocked or at an angle to the nail shank 52 and if driven into the face 56 of the material, would dig into it at an unsightly angle.

As previously mentioned, the present tool may be used to set a nail and in which case it may be desirable to permit the drive face of the rod to extend fully toward the barrel forward edge 20. With the above described means for varying the displacement of the rod, this forwardmost movement is readily achieved. With respect to this latter operation, the forward end member 34 of the rod may likewise comprise a removable element, similarly attached as by cooperating threads as at 62 in FIG. 2 or, alternatively, different rods having setting drive elements thereon, may be provided.

A further possible alteration of the above disclosed construction may involve forming the external periphery 64 of the barrel and/or the periphery 42 of the strike head 40 of a polygonal configuration to prevent the tool from rolling off an inclined surface when placed aside.

From the foregoing it will be appreciated that an improved nail driver is presented which offers many advantages. The user may wish to drive the nail head flush with the work piece surface, or, bury the head a short distance below the surface level for later filling with putty or the like. It may also be desirable to leave the head protruding in some applications, such as when the nail is to serve as a hook or is to be driven home later. With nails of uniform length, these various driving depths may be obtained with one nail after another by adjusting the collar strike head 40 to a specific position on the rod 32.

Although the nail N will be driven into the workpiece 56 from inside the barrel 12, wherein the nail body will be hidden from view, the user can tell the nail's progress into the workpiece by how far into the barrel 12 the rod 32 has progressed.

Although the above addresses the driving of bent nails, the very same tool may be used to initiate and follow through with the driving of straight nails. The present invention, besides allowing uniform depth of nail head insertion, also prevents waste from bent nails. If the nail N should bend during driving, the bulging part of the shank will come to rest against the inside wall 16 of the barrel 12 and stop bending. The nail cannot bend enough to prevent its insertion into the workpiece 56.

It is to be understood that the present invention is not limited to the embodiments described above, but encompasses any and all embodiments within the scope of the following claims.

I claim:

1. A nail driver comprising:

an elongated tubular barrel having a nail accepting forward end and an opposite rear end, said barrel provided with a cylindrical bore having an internal diameter adapted to accept a nail and its head, said barrel having a collar adjacent said rear end, said collar provided with an axial bore of less diameter than said barrel bore, a cylindrical rod having a diameter less than said collar bore and allowing for sliding passage of said rod therethrough, said rod having a forward end presenting a diameter greater than said rod diameter and less than said barrel bore diameter, said rod including a rear end axially disposed rearwardly of said barrel collar, a strike head on said rod rearward end and having a diameter greater than said rod diameter, said strike head including a forward face directed toward said barrel collar, and cooperating thread means on said rod rearward end and on said strike head for controlling the depth a nail is driven into a workpiece and for removably attaching together said rod rearward end and said strike head, such that upon relative rotation of said cooperating threads, said strike head is caused to be axially adjusted with respect to said rod rearward end, thus to vary the axial distance between said strike head front face and said rod forward end, whereby said axial distance may be adjusted to vary the amount any nail is driven into a workpiece, there being at least a pair of said strike heads of different overall axial length dimension, and otherwise being of substantially identical configuration, selectively threaded onto said rod rearward end, thus to vary the said axial distance between said strike head front face and said rod forward end, whereby said axial distance may be adjusted to vary the amount any nail is driven into a workpiece.

2. The nail driver according to claim 1, wherein said rod forward end is removably attached to said rod.

3. The nail driver according to claim 1, wherein said rod forward end comprises a flared member.

4. The nail driver according to claim 1, wherein said barrel includes an outer cylindrical periphery.

5. The nail driver according to claim 1, wherein said strike head includes an outer cylindrical periphery.

6. The nail driver according to claim 1, wherein said barrel bore defines a length sufficient to fully receive the entire length of a nail.

* * * * *